US011744350B2

(12) United States Patent
McEvilly et al.

(10) Patent No.: US 11,744,350 B2
(45) Date of Patent: Sep. 5, 2023

(54) STAND FOR MULTIPLE HAMMOCKS

(71) Applicant: Kammok Holdings, LLC, Austin, TX (US)

(72) Inventors: Greg McEvilly, Austin, TX (US); Henry Parker, Austin, TX (US)

( * ) Notice: Subject to any disclaimer, the term of this patent is extended or adjusted under 35 U.S.C. 154(b) by 0 days.

(21) Appl. No.: 17/389,323

(22) Filed: Jul. 29, 2021

(65) Prior Publication Data

US 2022/0031050 A1 Feb. 3, 2022

Related U.S. Application Data

(60) Provisional application No. 63/058,357, filed on Jul. 29, 2020.

(51) Int. Cl.
*A45F 3/24* (2006.01)

(52) U.S. Cl.
CPC ..... *A45F 3/24* (2013.01)

(58) Field of Classification Search
CPC ..... A45F 3/22; A45F 3/24; A45F 3/26; A45F 3/44
See application file for complete search history.

(56) References Cited

U.S. PATENT DOCUMENTS 838,078 A * 12/1906 Carbaugh ..... A45F 3/24 5/127
2,563,156 A * 8/1951 Carl ..... A45F 3/24 5/2.1
3,376,879 A * 4/1968 Huddle ..... E04H 15/56 135/121
4,951,332 A * 8/1990 Barmettler ..... A45F 3/24 5/120
5,423,341 A * 6/1995 Brady ..... E04H 15/48 135/147
5,588,702 A * 12/1996 Litwin ..... A47C 3/0255 297/277
5,666,986 A * 9/1997 Fox ..... E04H 15/42 135/147
5,729,845 A * 3/1998 Hsu ..... A45F 3/24 5/120
6,973,687 B1 * 12/2005 Tseng ..... A45F 3/24 5/127
7,243,383 B1 * 7/2007 Hennessy ..... A45F 3/24 5/127
9,700,123 B1 * 7/2017 Pinholster, Jr. ..... A45F 3/24
10,655,357 B1 * 5/2020 Graham ..... E04H 15/30
2004/0049848 A1 * 3/2004 Boyd ..... B63B 34/52 5/120
2005/0210582 A1 * 9/2005 Branch, III ..... A45F 3/24 5/127

(Continued)

*Primary Examiner* — David R Hare
*Assistant Examiner* — George Sun
(74) *Attorney, Agent, or Firm* — Travis Banta; Loyal IP Law, PLLC

(57) ABSTRACT

Disclosed herein is a hammock stand. The hammock stand may include a hub including a plurality of ends. The hammock stand may further include a plurality of braces which may be connected to on of the plurality of ends included in the hub. The plurality of braces may further include each hammock attachment point. At the center of the hammock stand, one or more support braces or a table providing structural support between the plurality of braces may be included.

20 Claims, 5 Drawing Sheets

(56) References Cited

U.S. PATENT DOCUMENTS

| | | | | |
|---|---|---|---|---|
| 2005/0246836 | A1* | 11/2005 | Wu | A45F 3/24 5/120 |
| 2011/0173748 | A1* | 7/2011 | Chu | A45F 3/24 5/129 |
| 2012/0233771 | A1* | 9/2012 | Lee | A45F 3/24 5/127 |
| 2016/0088922 | A1* | 3/2016 | Frankson | A45F 3/24 5/129 |
| 2016/0360869 | A1* | 12/2016 | Brooks | F16M 11/041 |
| 2018/0055201 | A1* | 3/2018 | Fries | A45F 3/24 |
| 2018/0228272 | A1* | 8/2018 | Locher | A45F 3/24 |
| 2018/0238041 | A1* | 8/2018 | Styrc | E04F 10/02 |
| 2020/0154880 | A1* | 5/2020 | Anderson | A47B 21/02 |

* cited by examiner

STAND FOR MULTIPLE HAMMOCKS

BACKGROUND

1. Technical Field

This disclosure relates generally to a stand for supporting multiple hammocks at one time. In particular, the stand may include multiple bases which connect to a head end or a foot end of two hammocks. Moreover, the stand may further include a central table that is removable or partially removable.

2. Description of the Related Art

Many historians credit ancient Greece for the invention of the hammock. However, history also indicates that hammocks were likely not in significant use in the old world until sometime after the discovery of the New World. European explorers found that the inhabitants of the new world slept in beds that were generally made of tree bark or fibers and suspended above the ground by attaching the bark or fibers on either end to a tree. Before long, many berths and bunks in sailing ships were provided for the crew by hammocks because the hammocks were not only more efficient in terms of space, but also were easier for the crew to sleep in when the ship was at sea. These hammocks used spreaders attached to canvas hammocks that could be attached by strings to wooden beams or other supports could be found. Hammocks are still used by sailors, on many ships, still today.

One difficulty of hammock use, especially in non-maritime environments, is finding a suitable location for setting up a hammock. Hammocks may be installed between two trees although finding two trees that are an appropriate distance apart which have a thickness or diameter of sufficient size to support a person, is not always a simple task in many forests. Other hammock stands have been developed which allow a single hammock or multiple hammocks to be deployed but many of these are dependent on having one or more counterweights or support two sides of a single hammock.

A need exists, therefore, to provide a hammock stand for multiple hammocks which does not require a counterweight to use. A further need exists for a hammock stand with a central hub that allows multiple hammocks to be suspended between bases, but that is also modular to add or remove hammocks as desired. A further need exists to provide a centralized support for a hammock stand, which may or may not also support a table.

SUMMARY

Disclosed herein hammock stand. The hammock stand may include a hub including a plurality of ends. The hammock stand may further include a plurality of braces which may be connected to one of the plurality of ends included in the hub. The plurality of braces may further each include a hammock attachment point.

BRIEF DESCRIPTION OF THE DRAWINGS

The accompanying drawings illustrate an embodiment of a hammock stand.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the hammock strap disclosed herein. While the techniques and embodiments will primarily be described in context with the accompanying drawings, those skilled in the art will further appreciate that the techniques and embodiments may also be practiced in other similar apparatuses.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
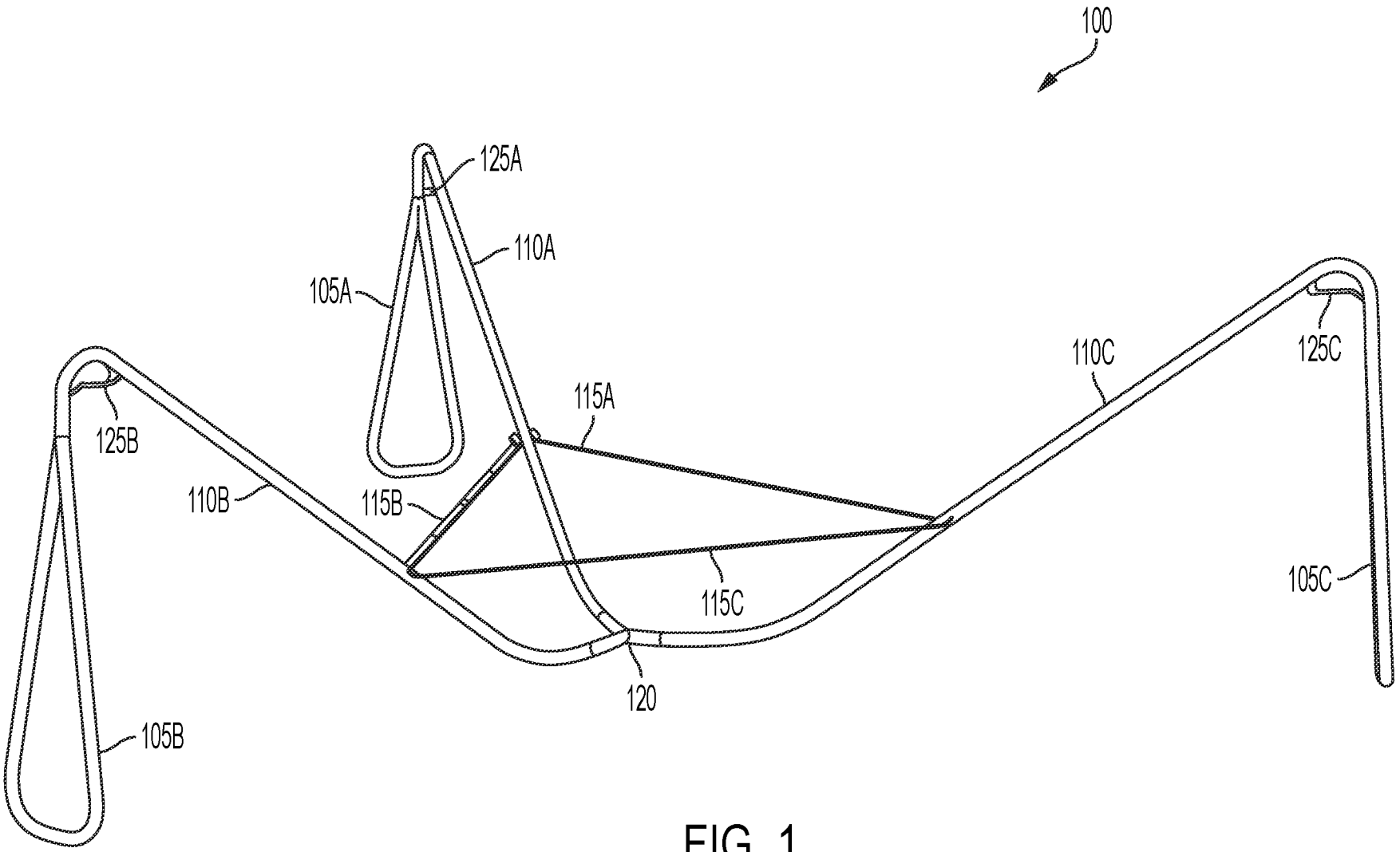
FIG. 1 illustrates perspective view of a stand for multiple hammocks.

FIG. 1 illustrates a illustrates perspective view of a stand 100 for multiple hammocks. Stand 100 includes a plurality of bases 105A, 105B, and 105C, which each serve as supports for stand 100. Bases 105A-105C may be made from a metal, carbon fiber, wood, or any other suitable material. In one embodiment, bases 105A-105C may be made from aluminum or steel tube. Bases 105A-105C may be generally tear drop or loop shaped having an opening in the middle with a flat section, upsetting the tear drop/loop shape, where bases 105A-105C contact a surface supporting stand 100.

Stand 100 further includes a plurality of braces 110A, 110B, and 110C which are connected to bases 105A, 105B, and 105C, respectively. For example, brace 110A may connect to base 105A, brace 110B may connect to base 105B, and brace 110C may connect to base 110C. Braces 110A, 110B, and 110C may be constructed as single pieces or may be constructed as an upper brace and a lower brace having one of the lower section and the upper section include a smaller diameter portion which acts as a male end which fits into a female end of the other of the upper or lower section of brace 110A, 110B, and 110C. Braces 110A, 110B, and 110C may be generally straight in a top half of braces 110A, 110B, and 110C to a curve where hammock attachment 125A-125C is positioned and may also include a slight curve in the lower half of braces 110A, 110B, and 110C to facilitate connection to hub 120 and to provide a wider area of contact with a surface under stand 100, such as the ground. In this manner, each hammock base 105A-105C may be supported on the ground, for example, by a wider ground contact area and relieve the need for a counterweight on an opposing side of stand 100.

Figure 5:
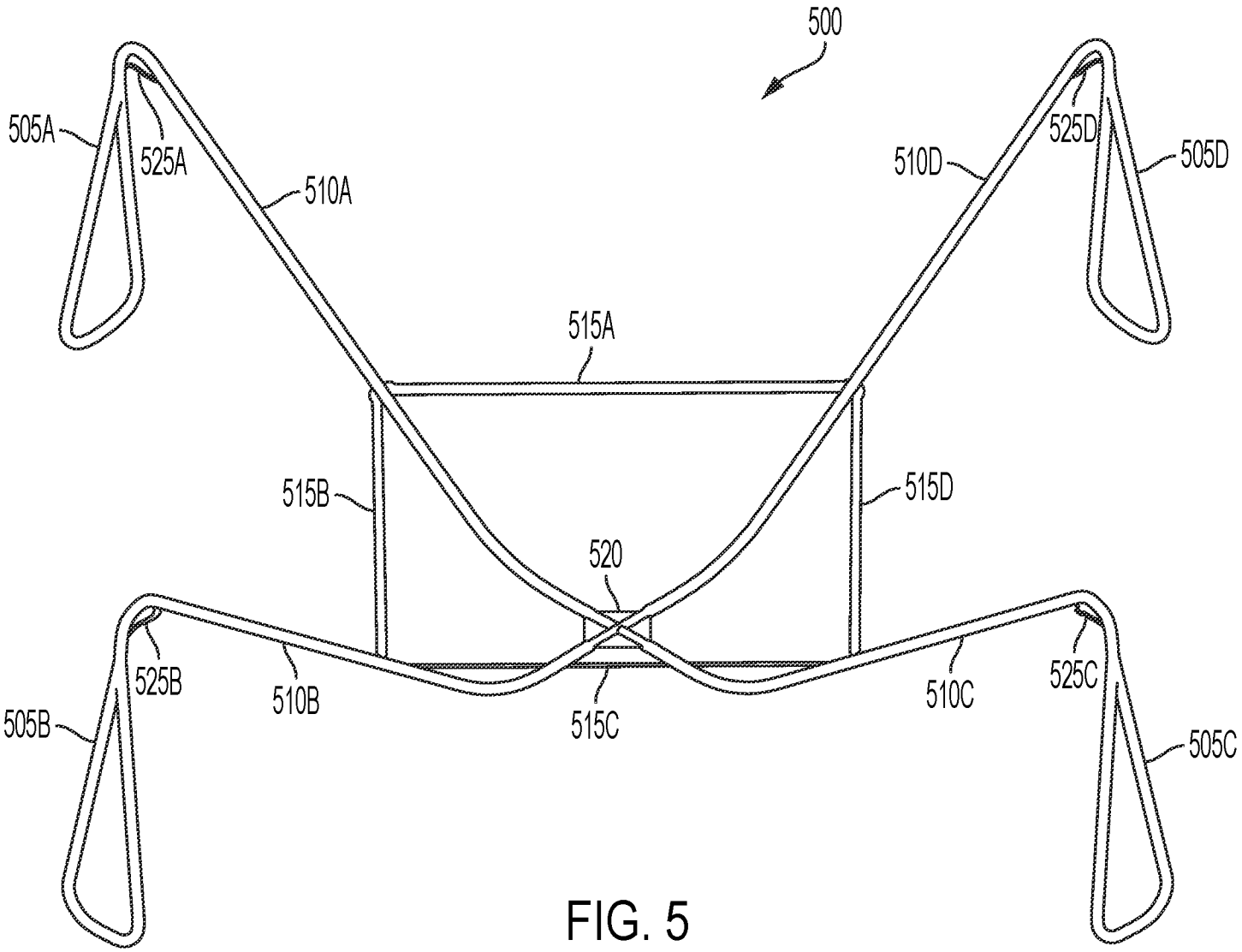
FIG. 5 illustrates a perspective view of a hammock stand for multiple hammocks.

Braces 110A, 110B, and 110C may be connected on a bottom end by hub 120. Hub 120 may include male ends, with diameters smaller than a bottom end of braces 110A, 110B, and 110C such that the male ends of hub 120 may fit into a female end of the bottom end of braces 110A, 110B, and 110C. It is also to be noted that in another embodiment, hub 120 may include female ends while braces 110A, 110B, and 110C include male ends which fit into the female ends of hub 120. Hub 120 may include a number of ends which accept a number of braces 110A, 110B, and 110C. As shown in FIG. 1, hub 120 may accept three braces. However, as shown in FIG. 5, hub 120 (520) may accept four braces. Braces 110A-110C having the same or substantially the same length may be connected by hub 120 whether hub 120 includes three ends or four ends. Braces 110A-110C may be lengthened slightly and progressively for hubs which include more and more ends.

Braces 110A-110C may be further supported by support connections 115A, 115B, and 115C. Support connectors 115A-115C may connect two of braces 110A-110C. For example, support connector 115A, may connect brace 110A and 110C. Support connector 115B may connect brace 110A and 110B. Support connector 115C may connect brace 110B and 110C. Support connectors 115A-115C provide additional rigidity between braces 110A-110C. Bases 105A-105C, braces 110A-110C, support connectors 115A-115C, and hub 120 may be made from a metal, carbon fiber, wood, or any other suitable material. In one embodiment, bases 105A-105C, braces 110A-110C, support connectors 115A-115C, and hub 120 may be made from aluminum or steel tube or flat stock, as appropriate, which may be fitted and fashioned in the manner described herein.

A top end of braces 110A-110C may further include a hammock attachment point 125A-125C. Hammock attachment points 125A-125C may be implemented to allow a hammock to attach to either side of braces 110A-110C. Hammock attachment points 125A-125C may be implemented as an opening created in a top of braces 110A-110C. For example, hammock attachment points 125A-125C may be created by, for example, welding a metal rod or element between the brace above the connector to the base and directly across to the brace, creating an opening between the metal rod or element and a bend in the brace. Hammocks may be attached to hammock attachment points 125A-125C. For example, a head end of a hammock may be connected to hammock attachment point 125A while a foot end of a hammock may be connected to hammock attachment point 1258. Similarly, a head of a second hammock may also attach to hammock attachment point 1258 while a foot end of the second hammock may attach to hammock attachment point 125C. It follows that a head end of a third hammock may attach to hammock attachment point 125C while a foot end of the third hammock may attach to hammock attachment point 125A.

Figure 2:
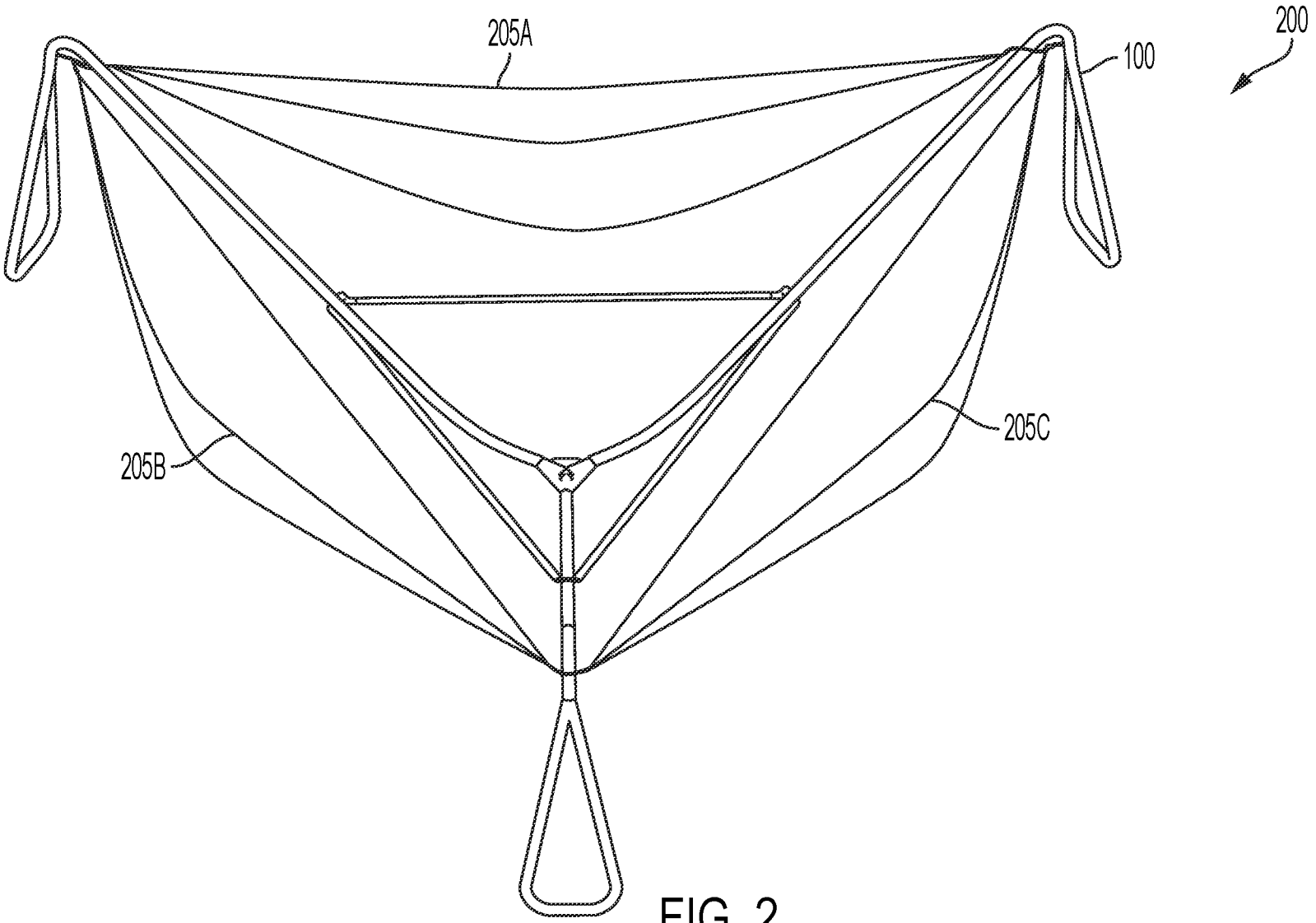
FIG. 2 illustrates a perspective view of a stand with multiple mounted hammocks.

FIG. 2 illustrates a perspective view of a stand 200 with multiple mounted hammocks 205A-205C. Hammock stand 200 includes hammock stand 100, shown and described above with respect to FIG. 1. However, as shown in FIG. 2, hammocks are installed in position on hammock stand 200. For example, hammock 205A may be attached at a first end to a brace and at a second end to another brace while a first end of hammock 205B may be attached to the same brace as the second end of hammock 205A and include a second end which is connected to another brace. Hammock 205C may have a first end which connects to the same brace as the second end of hammock 205B and a second end of hammock 205C may connect to the same brace as the first end of hammock 205A.

Figure 3:
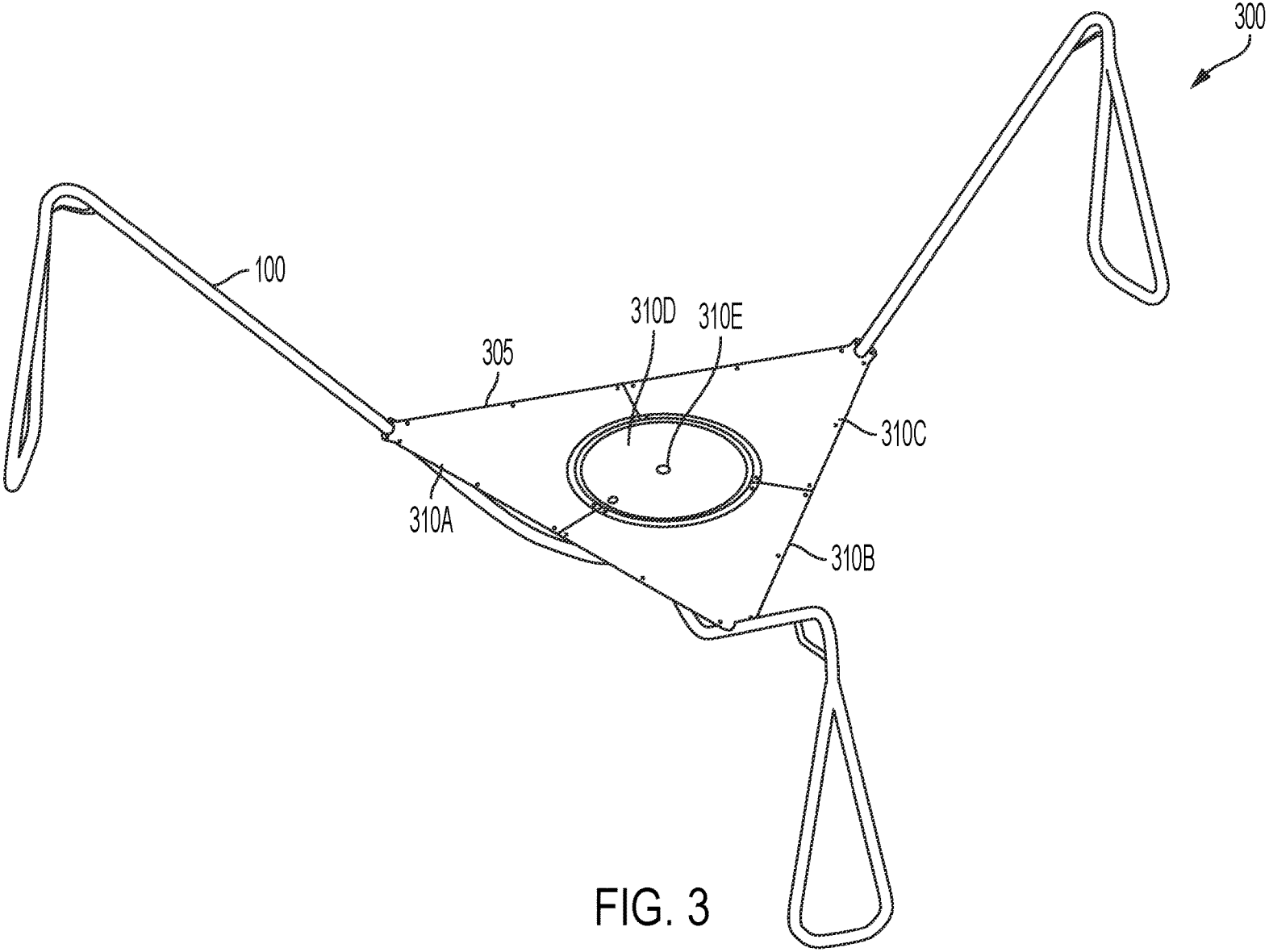
FIG. 3 illustrates a perspective view of a hammock stand with a central table.

FIG. 3 illustrates a perspective view of a hammock stand 300 with a central table 305. Hammock stand 300 includes hammock stand 100, shown and described above with respect to FIG. 1. As shown in FIG. 3, a table 305 is fitted over support connectors 115A-115C, shown and described above with respect to FIG. 1. Table 305 may be implemented as a single piece table which connects to support connectors 115A-115C or may be implemented in several pieces, as shown in FIG. 3. Table 305 may include a plurality of table elements which constitute table 305, such as table element 310A, 310B, 310C, and 310D. Table elements 310A-310D form essentially an equilateral triangle. However, table elements, such as table element 310D, for example, may be removed to accommodate other accessories. For example, table element 310D may be removed to accommodate a cooler disposed within the table. Alternatively, table element 310D may be retained in place and include one or more accessory ports 310E which may allow accessories to be installed on the table, such as an umbrella which may be large enough to cover all of stand 300.

Figure 4:
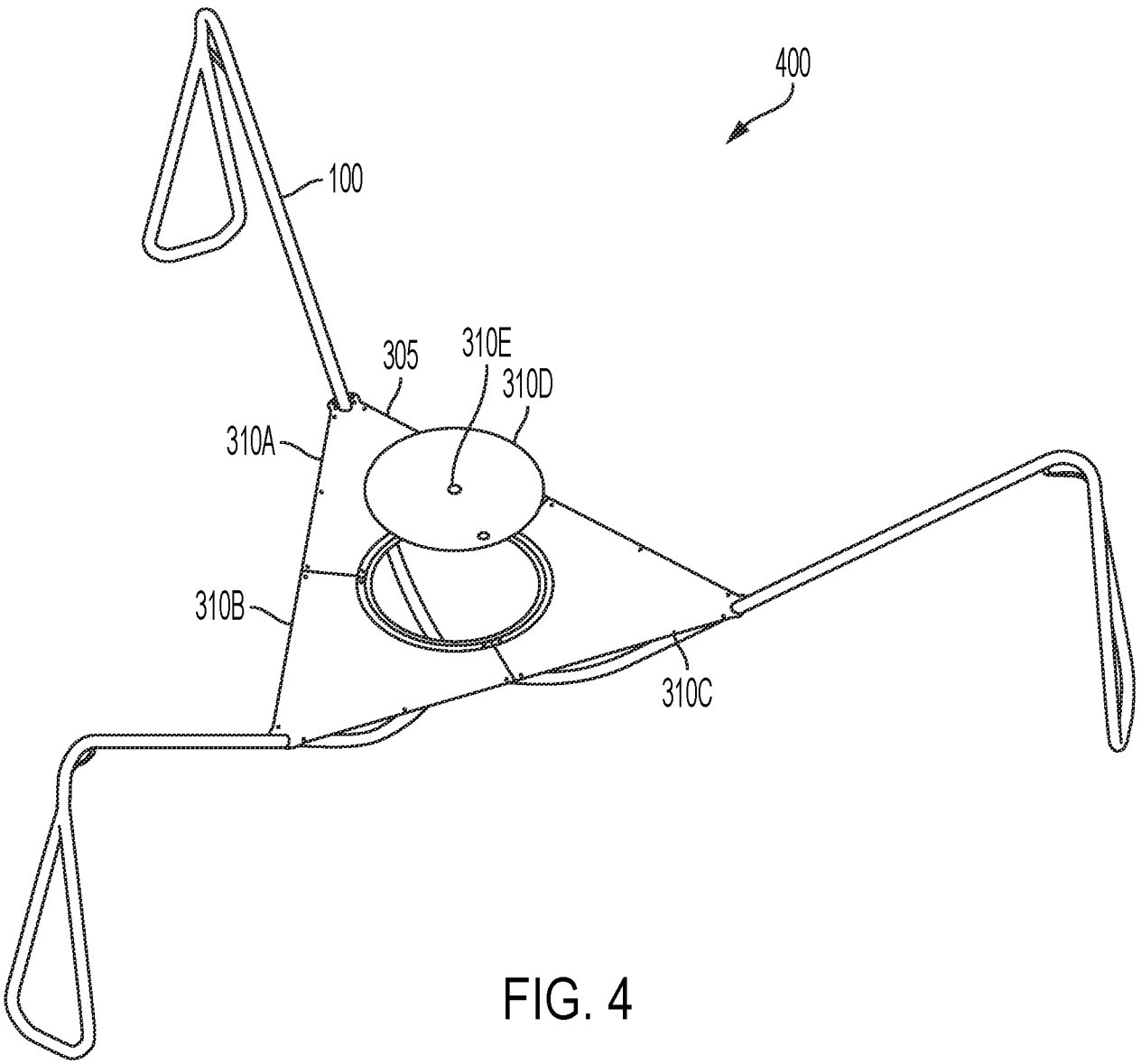
FIG. 4 illustrates a perspective view of a hammock stand with table having removable elements.

FIG. 4 illustrates a perspective view of a hammock stand 400 with table 305 having removable elements 310A-310D. Hammock stand 400 includes hammock stand 100, shown and described above with respect to FIG. 1. As shown in FIG. 4, a table 305 is fitted over support connectors 115A-115C, shown and described above with respect to FIG. 1. Table 305 may be implemented a single piece table which connects to support connectors 115A-115C or may be implemented in several pieces, as shown in FIG. 4. Table 305 may include a plurality of table elements which constitute table 305, such as table element 310A, 310B, 310C, and 310D. Table elements 310A-310D form essentially an equilateral triangle. As shown in FIG. 4, table elements, such as table element 310D, for example, may be removed to accommodate other accessories. For example, as illustrated in FIG. 4, table element 310D may be removed to accommodate a cooler disposed within the table. Alternatively, table element 310D may be retained in place and include one or more accessory ports 310E which may allow accessories to be installed on the table, such as an umbrella which may be large enough to cover all of stand 400.

FIG. 5 illustrates a perspective view of a hammock stand 500 for multiple hammocks. While four hammocks are shown in FIG. 5, hammock stand 500 may accommodate a plurality of hammocks, as discussed herein. Stand 500 includes a plurality of bases 505A, 505B, 505C, and 505D which each serve as supports for stand 500. Bases 505A-505D may be made from a metal, carbon fiber, wood, or any other suitable material. In one embodiment, bases 505A-505D may be made from aluminum or steel tube. Bases 505A-505D may be generally tear drop or loop shaped having an opening in the middle with a flat section, upsetting the tear drop/loop shape, where bases 505A-505C contact a surface supporting stand 500.

Stand 500 further includes a plurality of braces 510A, 510B, 510C, and 510D which are connected to bases 505A, 505B, 505C, and 505D, respectively. For example, brace 510A may connect to base 505A, brace 510B may connect to base 505B, brace 510C may connect to base 5100 and brace 510D may connect to base 510D. Braces 510A, 510B, 5100, and 510D may be constructed as single pieces or may be constructed as an upper brace and a lower brace having one of the lower section and the upper section include a smaller diameter portion which acts as a male end which fits into a female end of the other of the upper or lower section of brace 510A, 510B, 510C, and 510D. Braces 510A, 510B, 5100, and 510D may be generally straight in a top half of braces 510A, 510B, 510C, and 510D to a curve where hammock attachment 525A-525C is positioned and may also include a slight curve in the lower half of braces 510A, 510B, 510C, and 510D to facilitate connection to hub 520 and to provide a wider area of contact with a surface under stand 500, such as the ground. In this manner, each hammock base 505A-505D may be supported on the ground, for example, by a wider ground contact area and relieve the need for a counterweight on an opposing side of stand 500.

Braces 510A, 510B, 510C, and 510D may be connected on a bottom end by hub 520. Hub 520 may include male ends, with diameters smaller than a bottom end of braces 510A, 510B, 510C, and 510D such that the male ends of hub 520 may fit into a female end of the bottom end of braces 510A, 510B, 510C, and 510D. It is also to be noted that in another embodiment, hub 520 may include female ends while braces 510A, 510B, 510C, and 510D include male ends which fit into the female ends of hub 520. Hub 520 may include a number of ends which accept a number of braces 510A, 510B, 510C, and 510D. As shown in FIG. 5, hub 520 may accept four braces. Braces 510A-510D having the same or substantially the same length may be connected by hub 520 whether hub 520 includes three ends, four ends, or a plurality of ends. Braces 110A-110C may be lengthened slightly and progressively for hubs which include more and more ends.

Braces 510A-510D may be further supported by support connections 515A, 515B, 515C, and 515D. Support connectors 515A-515D may connect two of braces 510A-510D. For example, support connector 515A, may connect brace 510A and 510D. Support connector 515B may connect brace 510A and 510B. Support connector 515C may connect brace 510B and 510C. Support connector 515D may connect brace 510C and 510D. Support connectors 515A-515D provide additional rigidity between braces 510A-510D. Bases 505A-505D, braces 510A-510D, support connectors 515A-515D, and hub 520 may be made from a metal, carbon fiber, wood, or any other suitable material. In one embodiment, bases 505A-505D, braces 510A-510D, support connectors 515A-515D, and hub 520 may be made from aluminum or steel tube or flat stock, as appropriate, which may be fitted and fashioned in the manner described herein.

A top end of braces 510A-510D may further include a hammock attachment point 525A-525C. Hammock attachment points 525A-525D may be implemented to allow a hammock to attach to either side of braces 510A-510D. Hammock attachment points 525A-525D may be implemented as an opening created in a top of braces 510A-510D. For example, hammock attachment points 525A-525D may be created by, for example, welding a metal rod or element between the brace above the connector to the base and directly across to the brace, creating an opening between the metal rod or element and a bend in the brace. Hammocks may be attached to hammock attachment points 525A-525D. For example, a head end of a hammock may be connected to hammock attachment point 525A while a foot end of a hammock may be connected to hammock attachment point 525B. Similarly, a head of a second hammock may also attach to hammock attachment point 525B while a foot end of the second hammock may attach to hammock attachment point 525C. It follows that a head end of a third hammock may attach to hammock attachment point 525C while a foot end of the third hammock may attach to hammock attachment point 525D. A head end of a fourth hammock may attach to hammock attachment point 525D and a foot end of the fourth hammock may attach to hammock attachment point 525A.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A hammock stand, comprising:

a hub including a plurality of ends; a plurality of braces joined at the hub and extending outwardly and upwards from the hub each comprising:

an end connectable to one of the plurality of ends included in the hub, and a hammock attachment point, the hammock attachment point disposed such that two hammocks of a plurality of hammocks are attachable to opposing sides of each one of the plurality of braces, and a table disposable over the hub and between the plurality of braces.

2. The hammock stand of claim 1, further comprising a plurality of bases connectable to one or more of the plurality braces.

3. The hammock stand of claim 1, wherein one or more of the plurality of braces include a curve in a lower half of the one or more braces.

4. The hammock stand of claim 2, wherein one or more of the plurality of bases include a loop.

5. The hammock stand of claim 4, wherein the loop in the one or more of the plurality of bases further comprises a flat section where the one or more of the plurality of bases contacts a supporting surface.

6. The hammock stand of claim 3, wherein the table includes one or more table elements in the table disposable between the plurality of braces.

7. The hammock stand of claim 6, wherein the table is triangular.

8. The hammock stand of claim 6, wherein the table is square.

9. The hammock stand of claim 6, wherein the table is a single piece table.

10. The hammock stand of claim 6, wherein the table includes a plurality of table elements.

11. The hammock stand of claim 10, wherein one of the plurality of table elements includes a removable center table element comprising an accessory port.

12. The hammock stand of claim 6, wherein the table is disposed on a plurality of support connectors which are connected between the plurality of braces.

13. The hammock stand of claim 11, wherein the accessory port is sized to receive a cooler.

14. The hammock stand of claim 11, wherein the accessory port is sized to receive an umbrella.

15. The hammock stand of claim 14, wherein the umbrella extends to cover the entire hammock stand.

16. The hammock stand of claim 1, wherein one of the hammock attachment points of one of the plurality of braces receives both a first end of a first hammock and a first end of a second hammock.

17. The hammock stand of claim 16, wherein one of the hammock attachment points of one of the plurality of braces receives a second end of the first hammock and a first end of a third hammock.

18. The hammock stand of claim 17, wherein one of the hammock attachment points of one of the plurality of braces receives a second end of the second hammock and a second end of the third hammock.

19. The hammock stand of claim 17, wherein one of the hammock attachment points of one of the plurality of braces receives a second end of the third hammock and a first end of a fourth hammock.

20. The hammock stand of claim 19, wherein one of the hammock attachment points of one of the plurality of braces receives a second end of the fourth hammock and a second end of the second hammock.

* * * * *